US005274936A

United States Patent [19]

Fournier

[11] Patent Number: 5,274,936

[45] Date of Patent: Jan. 4, 1994

[54] HINGE ASSEMBLY

[76] Inventor: Emile Fournier, 2707 White Pine Way, Charlottesville, Va. 22901

[21] Appl. No.: 807,092

[22] Filed: Dec. 13, 1991

[51] Int. Cl.[5] ..... G09F 19/00

[52] U.S. Cl. ..... 40/533; 40/536; 40/530

[58] Field of Search ..... 40/533, 530, 497, 492, 40/493, 534, 535-; 16/338, 342, 253

[56] References Cited

U.S. PATENT DOCUMENTS

| | | | |
|---|---|---|---|
| 185,139 | 12/1876 | Schneider | 40/533 |
| 1,207,456 | 12/1916 | Whelan | 40/533 |
| 1,316,473 | 9/1919 | Adeling | 16/253 |
| 1,466,781 | 9/1923 | Auster | 16/338 X |
| 1,720,053 | 7/1929 | O'Brien | 40/497 |
| 1,865,863 | 7/1932 | Kraft | 40/533 X |
| 1,881,636 | 10/1932 | Johnson et al. | 40/533 X |
| 1,958,579 | 2/1933 | Johnson et al. | 40/533 X |
| 2,530,071 | 11/1950 | Nash | 40/533 |
| 3,945,140 | 3/1976 | Sullivan et al. | 40/530 |
| 4,180,341 | 12/1979 | Langhorst | 40/530 X |
| 4,294,029 | 10/1981 | Holson | 40/530 X |

*Primary Examiner*—Kenneth J. Dorner
*Assistant Examiner*—Milton Nelson, Jr.
*Attorney, Agent, or Firm*—Sheldon H. Parker

[57] ABSTRACT

A hinge member comprising a plurality of hinge units, each unit having a body portion, with a slotted region and an annular region. The annular region is formed by an elongated circular channel in a cylindrical portion of the hinge. An elongated groove in the slotted region of the body has a region of reduced thickness relative to the slotted region. The elongated groove intersecting with the elongated channel, with a first passage in the slotted region and a second passage in the region of reduced thickness. A ridge is thereby provided between the slotted region and the region of reduced thickness. The axis of the first passage means is parallel to the axis of the second passage and parallel to the axis of the elongated channel. The first passage has its axis perpendicular to the first surface of the slotted region.

9 Claims, 5 Drawing Sheets

HINGE ASSEMBLY

BACKGROUND OF THE INVENTION

1. Field of the Invention

The invention relates to a multiuse hinge assembly. More particularly, the invention relates to a reversible hinge assembly which is particularly suited for use with "A"-frame display signs.

2. Background of the Invention

"A"-frame display signs are in common use in such areas as real estate display notices, store front displays and the like. Most commonly, the display panels must be removed from the unit or must be unbolted to reverse the display.

In Kraft, U.S. Pat. No. 1,865,863, a blackboard is disclosed which is hinged to allow for a horizontal swing of a plurality of blackboards. The hinges are affixed to a wall and comprise multiple hinge arms for holding the blackboards.

In Johnson et al., U.S. Pat. No. 1,958,579, a blackboard is disclosed which is made up of a plurality of backboard panels which are connected by a hinge to a support.

In Kraft, U.S. Pat. No. 1,865,863, hinges similar to those disclosed in Johnson et al are disclosed.

While such hinges are known in the art, they fall short of providing the functionality required for "A"-frame display sign and other applications.

SUMMARY OF THE INVENTION

It has now been found that, through the use of a unique hinge design, improved hinge functionality can be achieved. The hinge assembly of the instant invention is made up of a plurality of hinge units. Each of the hinge units have a body portion which includes a slotted region, an annular region and a region of reduced thickness. The annular region has an elongated circular channel which serves as a passage for a rod.

The slotted region is formed by an elongated groove in an upper portion of the hinge unit. The elongated groove intersects with the circular channel. A region of reduced thickness relative to the slotted region with the elongated channel provides a ridge between the slotted region and the region of reduced thickness. Each of the slotted region and the region of reduced thickness are provided with holes for a screw or bolt. The bolt holes have their axis parallel to each other and perpendicular to the axis of the circular channel.

The hinge assembly includes at least two pairs of hinge units and a rod member. The rod member passing through the elongated circular channels in the cylindrical channel to provide a shaft upon which the hinges rotate and to function as a handle, if required, when used with "A"-frame display signs.

When used as a display sign, a first board member and a second board member are held together by the hinges. The first board member is secured to one hinge of each of the at least two pairs of hinge units. The second board member is secured to another hinge of each of the at least two pairs of hinge units. The assembly is connected by the rod member.

Bolts which pass through the bolt holes in the slotted region serve to compress the slotted region, thereby squeezing the rod and preventing movement of the rod relative to the hinge member. As long as the rod is prevented from moving relative to any one hinge, the entire assembly is held together.

The annular region preferably, has an axial length which is greater than the width of the slotted region thereby providing a "T"-shaped configuration. The "T"-shaped configuration assures that adjacent edges of the slotted regions and the reduced thickness regions of adjacent hinge units are separated by a clearance space.

When the hinge assembly is employed in conjunction with a display sign, the display sign assembly would include at least two pairs of hinge members. Each of the pairs of hinge members have a construction as noted above. A pair of board members are provided such that each of the board members is secured to a hinge unit of each pair of hinge members.

The display sign's boards are rotatable about the rod member, through an arc of about 330 degrees from a first position in which the first surface of the first board faces the first surface of the second board to a second position in which the second surface of the first board faces the second surface of the second board.

BRIEF DESCRIPTION OF THE DRAWINGS

The objects of the invention and features of the present invention will more fully become apparent from the following detailed description taken in connection with the drawings, wherein.

DETAILED DESCRIPTION OF THE DISCLOSURE

The hinge 10 of the instant disclosure is a single unit which can be used to support a two panel display sign. The hinge assembly 22, which is formed from a plurality of hinges 10, can be employed with gates and the like, but is uniquely suited to produce a novel reversible "A"-frame display sign.

In the preferred embodiment, the hinge is injection molded from a plastic such a polypropylene, although other materials can be used which provide a product meeting the requirements as disclosed herein.

Figure 1:
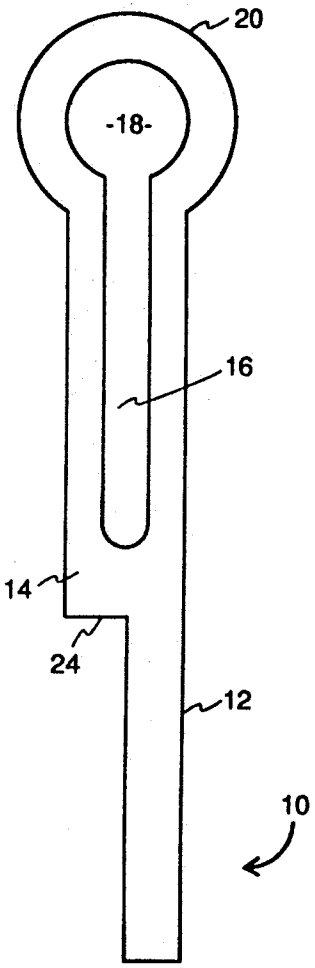
FIG. 1 is an end view of a hinge element of the present invention.

The hinge 10 of FIG. 1 has one of its sides 12 which is longer than the other side 14. Stated another way, the unit has a slotted upper region and a reduced thickness lower region. The sides 12 and 14 are of a length sufficient to support the size of the sign being attached thereto. The ridge 24 formed by the reduction in the cross-sectional thickness of the hinge 10, provides a mechanism for positioning the boards 30 and 31. The ridge 24 restricts the movement of the boards 30 and 31 relative to the hinges 10 and 11 and relative to each other. The ridge 24 also provides a firm fit against the upper edge of the board providing a flat surface against flat surface fit, preventing relative movement of the board and hinge. The placement of the hinges 10 and 11 is with the sides 12 being adjacent to one another creating a "T"-shape. The ridges 24 create the top portion of the top of the "T" with the sides 12 forming the leg of the "T". Thus, during rotation of the hinges 10 and 12, the abutting "T" surfaces function as bearing surfaces and spacers.

The slotted region 16 extends a substantial portion of the length of the combined sides 12 and 14, however it must not extend so far as to weaken the unit. The rod receiving portion 18 is at one end of the slotted region 16 and provides a receiving region for the rod 23 of FIG. 2. The rod receiving portion 18 must be spaced from the upper edge of the boards 30 and 31 by a distance sufficient to permit a user's fingers to be placed between the handle 21 and the board upper edge. This clearance is determined by the length of the side 14 and must be taken into manufacturing specifications.

Figure 2:
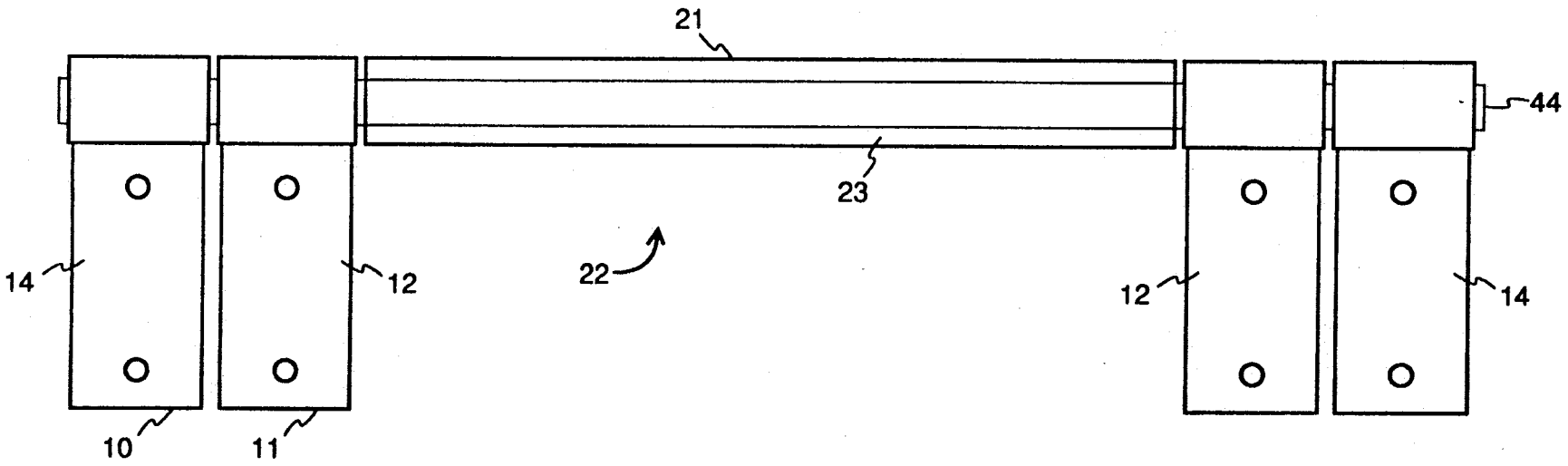
FIG. 2 is a front view of a hinge assembly.
Figure 7:
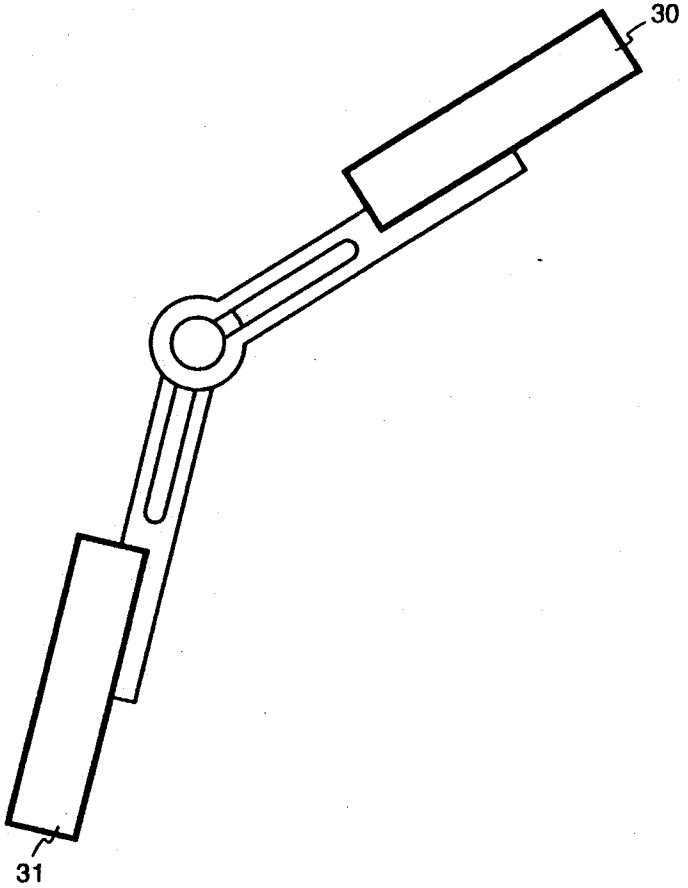
FIGS. 6 through 9 illustrate the rotation of a hinge assembly.
Figure 6:
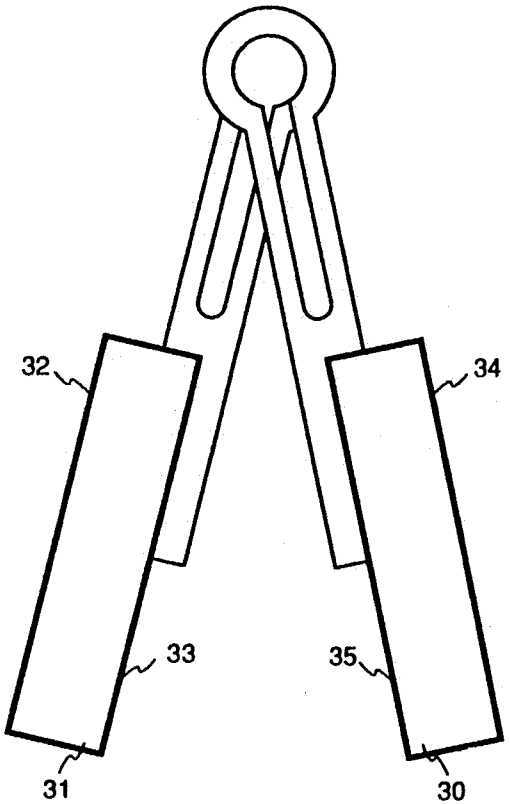

The assembled unit 22 is illustrated in FIG. 2 wherein hinges 10 and 11 have been assembled on the rod 23. The hinges are placed in pairs at each end of the rod 23 with the pairs being separated by a handle unit 21. The handle unit 21 can be extruded from polypropylene or manufactured in rubber or any other material which would provide a surface for gripping. The ends 44 of the rod 2 do not need to be enlarged to prevent the hinges 10 and 11 from slipping from the rod 23. The mounting of the boards 30 and 31 will secure the hinges 10 and 11 in place.

Figure 3:
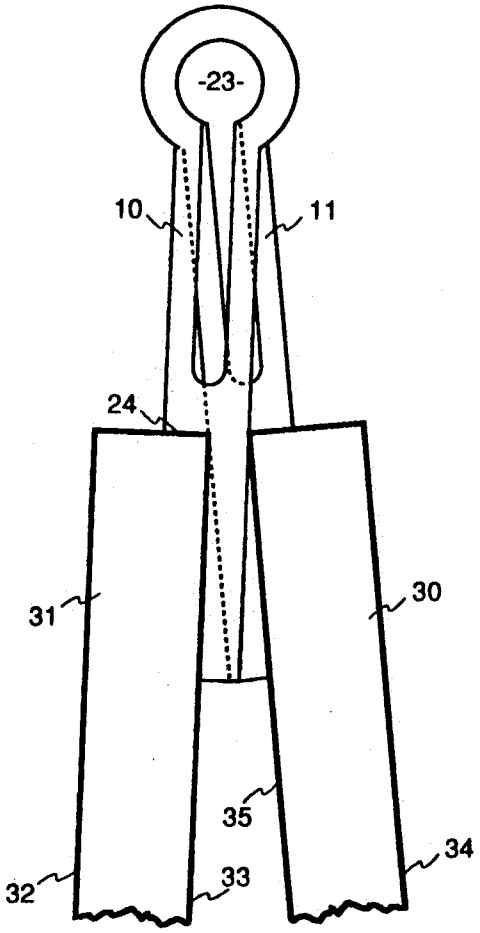
FIG. 3 is a fragmentary end view of the assembly of FIG. 2, further showing display boards.

As shown in FIG. 3, the boards 30 and 31 have been affixed to the hinges 10 and 11 respectively. The board 30 has been connected to the hinge 10 and has two sides 32 and 33. The board 31 has been connected to hinge 11 with sides 34 and 35. The upper edge of the board 30 abuts the ridge 24 of the hinge 10. The upper edge of the board 31 would abut an equivalent ridge on hinge 11.

Figure 4:
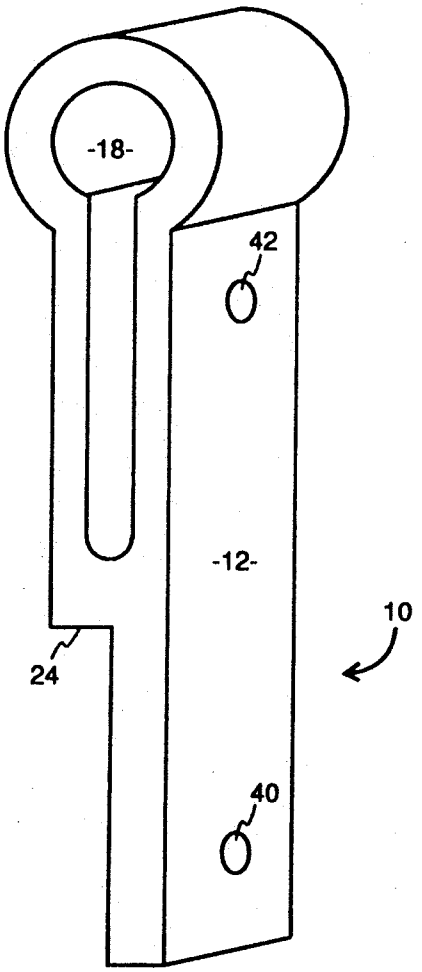
FIG. 4 is a perspective view of the hinge unit of FIG. 1.
Figure 5:
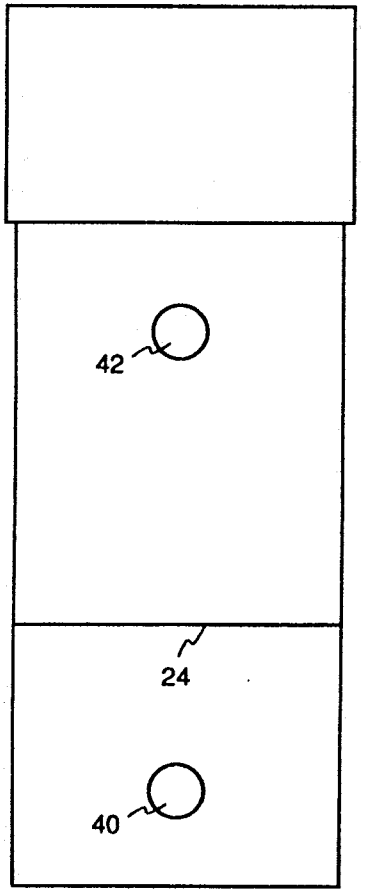
FIG. 5 is a front view the hinge unit of FIG. 4.

The hinge 10 is shown in FIGS. 4 and 5 at angled and side views. The screw receiving hole 40 is placed in the lower portion of side 12 and is used to affix the board 31 to the hinge 10 through means well known in the prior art. The tension adjusting bolt hole 42 is placed in the upper portion of the sides 12 and 14 in alignment with the slotted region 16. A bolt (not shown) is placed through the tension adjusting bolt hole 42, extending through the sides 12 and 14 and secured with a nut. Other securing means, as well known in the prior art, can be employed to secure the board 31 to the hinge 10, either permanently or removably. In the preferred embodiment, however, the boards 30 and 31 are removably affixed to the hinges 10 and 11. The bolt can be tightened to force the sides 12 and 14 toward each, narrowing the width of the slotted region 16. This forces the rod receiving portion 18 top tighten around the rod 23 to prevent excessive movement. The bolt is loosened to allow for easy reversal of the boards 30 and 31 and then tightened to lock the boards 30 and 31 in the desired position.

Figure 9:
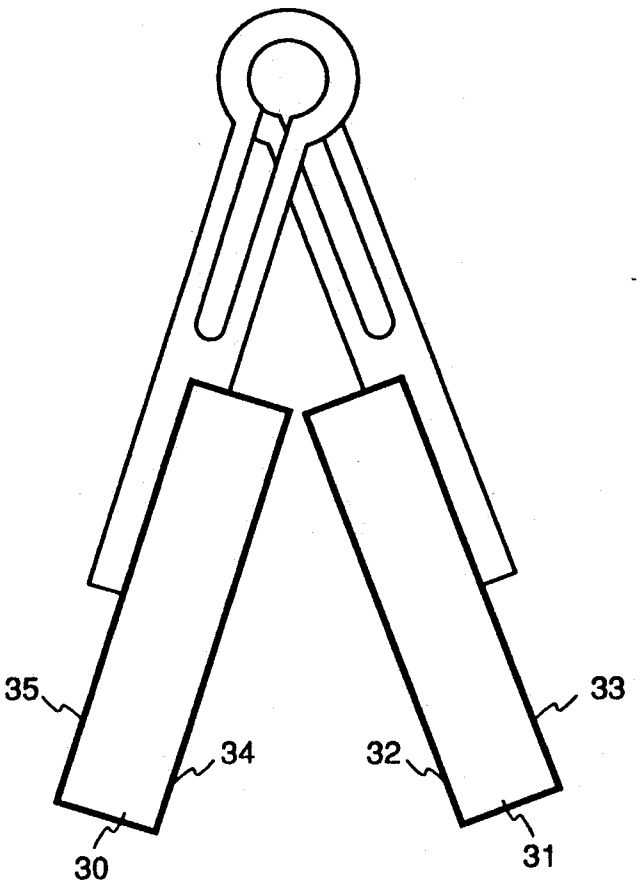
Figure 8:
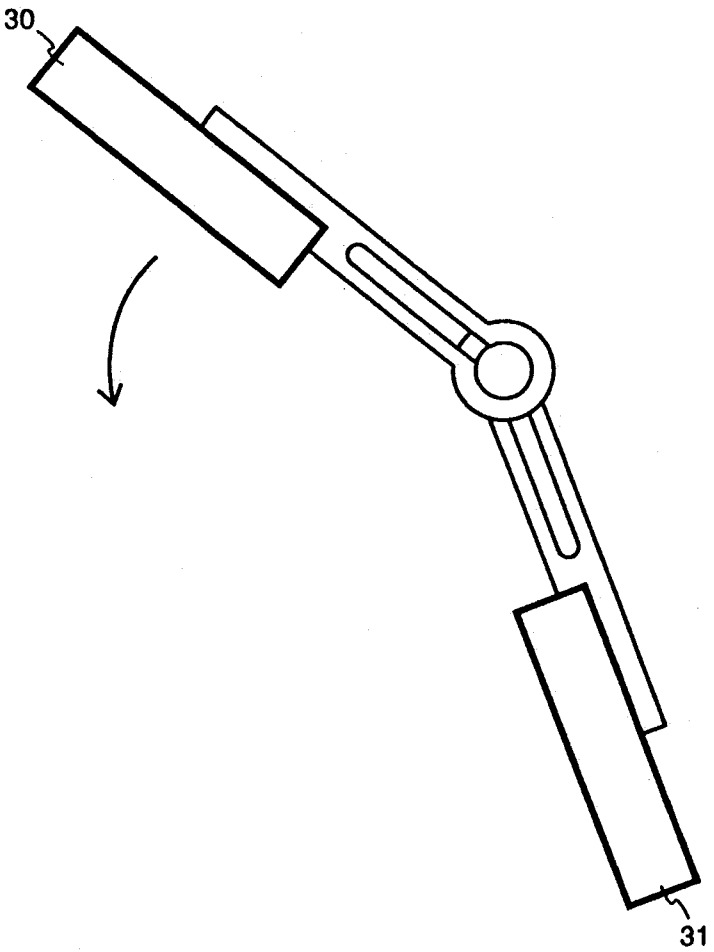

As illustrated in FIGS. 6 through 9, the reversing of the signs is accomplished by rotating the boards 30 and 31 about the rod 23. As evident from a comparison of FIGS. 6 and 9 the rotation of the sign units produces a reversal of the exposed side of the boards 30 and 31 which is being displayed. As previously stated, the tension in the rod receiving portion 18 is loosened allowing the boards 30 and 31 to rotate freely around the rod 23. The tension is then tightened when the boards 30 and 31 reach the desired placement as illustrated in FIG. 9.

Figure 10:
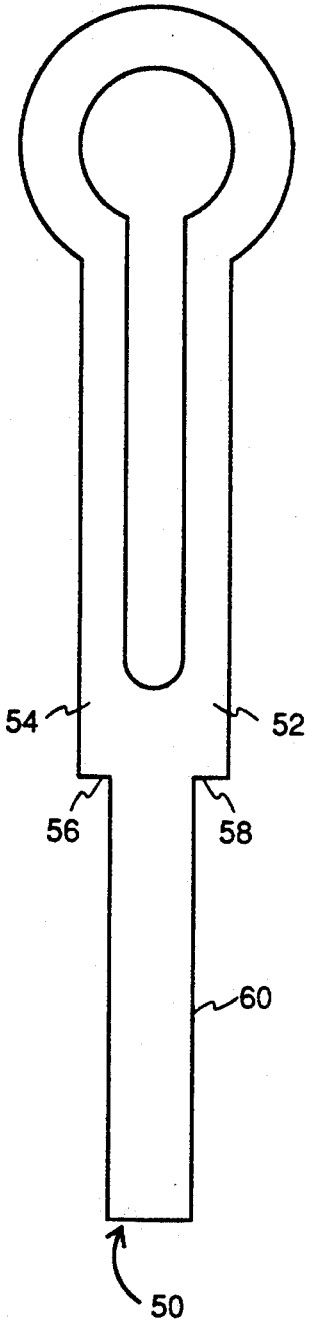

FIG. 10 illustrates an alternate embodiment to the hinge 10. The hinge 50 is extruded or injection molded with the sides 52 and 54 of equal lengths. The board receiving area 60 narrows equally on both sides providing a pair of ridges 56 and 58. This allows the boards 30 and 31 to be placed on either side of the hinge 50 and eliminates the need to reverse the hinges as illustrated with hinges 10 and 11.

What is claimed is:

1. A hinge device, said hinge device comprising a plurality of hinge units, each of said hinge units having: a body portion, said body portion having a first end, a cylindrical region, a mid region, a reduced region, and a second end, said first end being opposite said second end, said cylindrical region being at said first end of said body portion and having an elongated interior circular channel, an elongated groove within said mid region, said elongated groove extending radially from said elongated circular channel through at least a major portion of said mid region of said body portion toward said second end, said reduced region having a recessed region extending from said mid region to said second end of said body portion, said reduced region having a thickness less than the thickness of said mid region of said body portion, thereby providing a shoulder at the juncture of said mid region and said reduced region, a first bolt passage means, said first passage extending through said mid region and having its axis perpendicular to the plane of said elongated groove, thereby intersecting said elongated groove;

a second bolt passage mans, said second passage extending through said reduced region and having its axis parallel to the axis of said first passage means;

said hinge device also comprising:

a plurality of first bolt means, each of said first bolt means being positioned in one of said first bolt passage means, whereby tightening a first bolt means compresses a mid region and a corresponding cylindrical region.

2. The hinge device of claim 1, wherein said hinge device comprises a first pair of hinge units and a second pair of hinge units, and further comprising a rod member, said rod member passing through said elongated circular channels in said cylindrical region of each hinge unit member.

3. The hinge device of claim 2, further comprising a plurality of second bolt means, a first board member and a second board member, each of said first board member and said second board member having a bolt receiving passage, said first pair of hinge units being positioned on said rod member such that the respective reduced regions face each other, and said second pair of hinge units being positioned on said rod member such that the respective reduced regions face each other, each of said second bolt means being positioned in one of said hinge unit second bolt passage means and a corresponding board bolt receiving passage, such that each board is connected to one hinge unit of each pair of hinge units, said first board member is secured to said reduced region of one hinge unit of each of said two pairs of hinge units and said second board member is secured to said reduced region of the other hinge unit of each of said two pairs of hinge units, said first board being rotatable about said rod member relative to said second board;

whereby in a first rotated position a first side of each board faces each other and in the opposite rotated position the obverse of each board faces each other.

4. A display sign, said display sign comprising:

a first display board, a second display board, a plurality of hinge assemblies, and a rod member, each of said hinge assemblies comprising:

a first pair of hinge members and a second pair of hinge members, each of said first pair of hinge members and said second pair of hinge members having:

a body portion, said body portion having a first end, a cylindrical region, a mid region, a reduced region, and a second end, said first end being opposite said second end, said cylindrical region being at said first end of said body portion and having an elongated interior circular channel, an elongated groove within said mid region, said elongated groove extending radially from said elongated circular channel through at least a major portion of said mid region of said body portion toward said second end, said reduced region having a recessed region extending from said mid region to said second end of said body portion, said reduced region having a thickness less than the thickness of said mid region of said body portion, thereby providing a shoulder at the juncture of said mid region and said said reduced region, a first bolt passage means, said first passage extending through said mid region and having its axis perpendicular to the plane of said elongated groove, thereby intersecting said elongated groove;

a second bolt passage means, said second passage extending through said reduced region and having it axis parallel to the axis of said first passage means;

said display sign further comprising:

a plurality of first bolt means, each of said first bolt means being positioned in one of said first bolt passage mans, whereby tightening a first bolt means compresses a mid region and a corresponding cylindrical region, said rod member passing through each said cylindrical channel and being dimensioned relative to each said cylindrical channel such that tightening of a first bolt means to compress a corresponding mid region, compresses a corresponding elongated groove and circular channel, preventing movement of said corresponding rod relative to said hinge member, and each of said board members being secured to said reduced thickness region of at least one hinge member of each pair of hinge members.

5. The display sign of claim 4, wherein said boards are rotatable about said rod member, through an arc of about 330 degrees from a first position in which a first surface of said first board faces a first surface of said second board to a second position in which a second surface of said first board faces a second surface of said second board.

6. The display sign of claim 4, wherein one of said first bolt means is tightened to compress said rod and prevent movement of one of said hinge members relative to said rod member.

7. The display sign of claim 4, wherein each of said first display and said second display board has an upper edge, and wherein each said upper edge is in contact with a respective shoulder of each corresponding juncture region, thereby restricting movement of each said board relative to said hinge members and relative to each other.

8. The display signal of claim 7, said rod member being spaced from each said board upper edge by a distance sufficient to permit a user's fingers to be placed between said rod and each said board upper edge, whereby said rod can function as a handle member.

9. The display sign of claim 8, said pairs of hinge members being spaced from each other by a distance at least sufficient to permit a user's fingers to be placed between said rod, said upper edges of each of said boards, and said pairs of hinge members thus facilitating said rod's functioning as a handle member.

* * * * *